US009938922B2

(12) United States Patent
Whitaker

(10) Patent No.: US 9,938,922 B2
(45) Date of Patent: Apr. 10, 2018

(54) FUEL INJECTION SYSTEM AND METHOD COMBINING PORT FUEL INJECTION WITH DIRECT FUEL INJECTION

(71) Applicant: AVL Powertrain Engineering, Inc., Plymouth, MI (US)

(72) Inventor: Paul Andrew Whitaker, Northville, MI (US)

(73) Assignee: AVL Powertrain Engineering, Inc., Plymouth, MI (US)

( * ) Notice: Subject to any disclaimer, the term of this patent is extended or adjusted under 35 U.S.C. 154(b) by 732 days.

(21) Appl. No.: 14/561,567

(22) Filed: Dec. 5, 2014

(65) Prior Publication Data

US 2015/0159579 A1 Jun. 11, 2015

Related U.S. Application Data

(60) Provisional application No. 61/912,174, filed on Dec. 5, 2013.

(51) Int. Cl.

| | |
|---|---|
| ***F02M 51/00*** | (2006.01) |
| ***F02D 41/30*** | (2006.01) |
| ***F02M 63/02*** | (2006.01) |
| ***F02M 63/00*** | (2006.01) |
| ***F02D 41/32*** | (2006.01) |

(Continued)

(52) U.S. Cl.

CPC ..... *F02D 41/3094* (2013.01); *F02D 41/32* (2013.01); *F02D 41/38* (2013.01); *F02M 59/102* (2013.01); *F02M 59/105* (2013.01); *F02M 59/366* (2013.01); *F02M 59/38* (2013.01); *F02M 63/0059* (2013.01);

(Continued)

(58) Field of Classification Search

CPC ..... F02D 41/3094; F02D 41/38; F02D 41/32; F02D 41/3845; F02M 69/046; F02M 59/366; F02M 59/38; F02M 59/105; F02M 59/102; F02M 63/02; F02M 63/0059

See application file for complete search history.

(56) References Cited

U.S. PATENT DOCUMENTS

| | | | |
|---|---|---|---|
| 6,866,025 | B1 | 3/2005 | Maass |
| 7,281,517 | B2 | 10/2007 | Miyazaki et al. |

(Continued)

FOREIGN PATENT DOCUMENTS

| | | | |
|---|---|---|---|
| EP | 2143916 | A1 | 1/2010 |
| WO | 2008/002505 | A2 | 1/2008 |

*Primary Examiner* — Hung Q Nguyen

(74) *Attorney, Agent, or Firm* — Harness, Dickey & Pierce, P.L.C.

(57) ABSTRACT

A system and method for injecting fuel into an engine is provided where a low-pressure fuel pump is connected in fluid communication with at least one port fuel injector and a high-pressure fuel pump is connected in fluid communication with at least one direct fuel injector. The port fuel injector is disposed along an intake path of the engine and the direct fuel injector is disposed adjacent a cylinder of the engine. A lost motion lifter selectively couples the high-pressure fuel pump and the engine. A pump deactivation module switches the lost motion lifter to selectively deactivate the high-pressure fuel pump from the engine in response to partial load operation of the engine. The pump deactivation module may additionally switch the port fuel injector to an activated state and the direct fuel injector to a deactivated state.

27 Claims, 4 Drawing Sheets

(51) Int. Cl.

| | |
|---|---|
| ***F02D 41/38*** | (2006.01) |
| ***F02M 59/10*** | (2006.01) |
| ***F02M 59/36*** | (2006.01) |
| ***F02M 59/38*** | (2006.01) |
| ***F02M 69/04*** | (2006.01) |

(52) U.S. Cl.
CPC ..... *F02M 63/02* (2013.01); *F02M 69/046* (2013.01); *F02D 41/3845* (2013.01)

(56) References Cited

U.S. PATENT DOCUMENTS

| | | | | |
|---|---|---|---|---|
| 7,409,941 | B2 | 8/2008 | Spath et al. | |
| 8,215,276 | B2 | 7/2012 | Hendriksma | |
| 2010/0275866 | A1 | 11/2010 | Kangas et al. | |
| 2012/0048242 | A1* | 3/2012 | Surnilla ..... | F02D 19/022 123/497 |
| 2012/0186546 | A1 | 7/2012 | Cecur et al. | |
| 2013/0333660 | A1* | 12/2013 | Bartsch ..... | F02B 17/005 123/294 |

* cited by examiner

FUEL INJECTION SYSTEM AND METHOD COMBINING PORT FUEL INJECTION WITH DIRECT FUEL INJECTION

CROSS-REFERENCE TO RELATED APPLICATIONS

This application claims the benefit of U.S. Provisional Application No. 61/912,174, filed on Dec. 5, 2013. The entire disclosure of the above application is incorporated herein by reference.

FIELD

The present disclosure relates to a fuel injection system and method that combines port fuel injection with direct fuel injection. More particularly, the fuel injection system and method disclosed provides for deactivation of a high-pressure fuel pump when the engine is at partial load operating conditions.

BACKGROUND

As average fuel prices steadily climb, there remains a need for ever more efficient internal combustion engines. With the goal of increasing engine efficiency, improvements to fuel injection technology have been made. Many engines today employ port fuel injection systems where port fuel injectors are disposed along an intake path that leads to the cylinders of the engine. Accordingly, the air and fuel are mixed before entering the cylinders of an engine that has port fuel injection.

In an effort to further increase engine efficiency, many manufactures are now switching from port fuel injection to direct fuel injection. In direct fuel injection systems, direct fuel injectors are positioned to directly inject fuel into the cylinders of the engine. Accordingly, the air and fuel are mixed in the cylinder itself. When direct fuel injection is employed, the fuel that is directly injected into the cylinders has a charge cooling effect. That is, the fuel being directly injected into the cylinders reduces the temperature of the intake charge as latent heat is absorbed from the intake charge to evaporate the fuel. This reduction in temperature allows for high compression ratios to be used, which in turn increases the efficiency of the engine. However, the efficiency increase associated with direct fuel injection is offset by poorer mixing of the air and fuel mixture relative to port fuel injection systems. Additionally, direct fuel injection increases the pumping mean effective pressure of the engine, which translates into less efficient engine throttling at low to midrange engine speeds.

To capitalize on the efficiency advantages of direct fuel injection while attempting to minimize some of the noted draw backs, manufacturers are now fitting engines with combined port fuel injection and direct fuel injection systems. While these combined fuel injection systems can achieve efficiency advantages over engines that have only port fuel injection or only direct fuel injection, the efficiency gains of these combined systems are limited by the parasitic friction losses associated with the need for simultaneously driving two fuel pumps for supplying both the port fuel injectors and direct fuel injectors. Such parasitic losses are particularly limiting with respect to the fuel pump that supplies fuel to the direct fuel injectors because a high fuel pressure is required for direct fuel injection. What is needed is a fuel injection system that combines port fuel injection with direct fuel injection and reduces the parasitic losses associated with the high-pressure fuel pump that supplies fuel to the direct fuel injectors.

SUMMARY

Generally, the subject disclosure provides a fuel injection system and method that combines port fuel injection with direct fuel injection.

In one form, a fuel injection system for an engine having an intake path leading to at least one cylinder is disclosed. The fuel injection system includes a low-pressure fuel pump for supplying fuel at a first pressure and a high-pressure fuel pump for supplying fuel at a second pressure. The second pressure is greater than the first pressure, meaning that the fuel pressure supplied by the high-pressure fuel pump is greater than the fuel pressure supplied by the low-pressure fuel pump. The fuel injection system also includes at least one port fuel injector disposed along the intake path of the engine and at least one direct fuel injector disposed adjacent the at least one cylinder of the engine. The at least one port fuel injector is connected in fluid communication with the low-pressure fuel pump. Meanwhile, the at least one direct fuel injector is connected in fluid communication with the high-pressure fuel pump. The fuel injection system further includes a lost motion lifter selectively coupling the high-pressure fuel pump and the engine. The high-pressure fuel pump supplies fuel to the at least one direct fuel injector when the high-pressure fuel pump is coupled to the engine by the lost motion lifter in response to full load operation of the engine. The lost motion lifter selectively decouples the high-pressure fuel pump from the engine in response to partial load operation of the engine, where the high-pressure fuel pump does not supply fuel to the at least one direct injector.

In another form, a method of injecting fuel into an intake path of an engine having at least one cylinder is disclosed. The method includes providing a low-pressure fuel pump connected in fluid communication with at least one port fuel injector and a high-pressure fuel pump connected in fluid communication with at least one direct fuel injector. The high-pressure fuel pump is selectively coupled to the engine. The method also includes receiving at least one operating parameter of the engine. The at least one operating parameter of the engine correlates with engine load and the method includes detecting partial load operation and full load operation of the engine based on the at least one operating parameter of the engine. The method further includes decoupling the high-pressure fuel pump from the engine in response to detecting partial load operation of the engine. The method may also include coupling the high-pressure fuel pump to the engine in response to detecting full load operation of the engine.

Advantageously, the fuel injection system and the method disclosed provide increased efficiency of the engine because the high speed fuel pump is decoupled at partial load operation. Accordingly, the benefits associated with direct fuel injection and the higher compression ratios that direct fuel injection enables can be realized during full load operation of the engine. At the same time, the parasitic losses associated with the high-pressure fuel pump that is required for direct fuel injection are eliminated at partial load operation because the disclosed fuel injection system switches to port fuel injection and decouples the high-pressure fuel pump during partial load operation of the engine.

DRAWINGS

The features and advantages described above and other features and advantages of the present disclosure will be readily appreciated, as the same becomes better understood by reference to the following detailed description when considered in connection with the accompanying drawings. These drawings are for illustrative purposes of only select embodiments and not all possible implementations and are not intended to limit the scope of the present disclosure, wherein.

DETAILED DESCRIPTION

Figure 1:
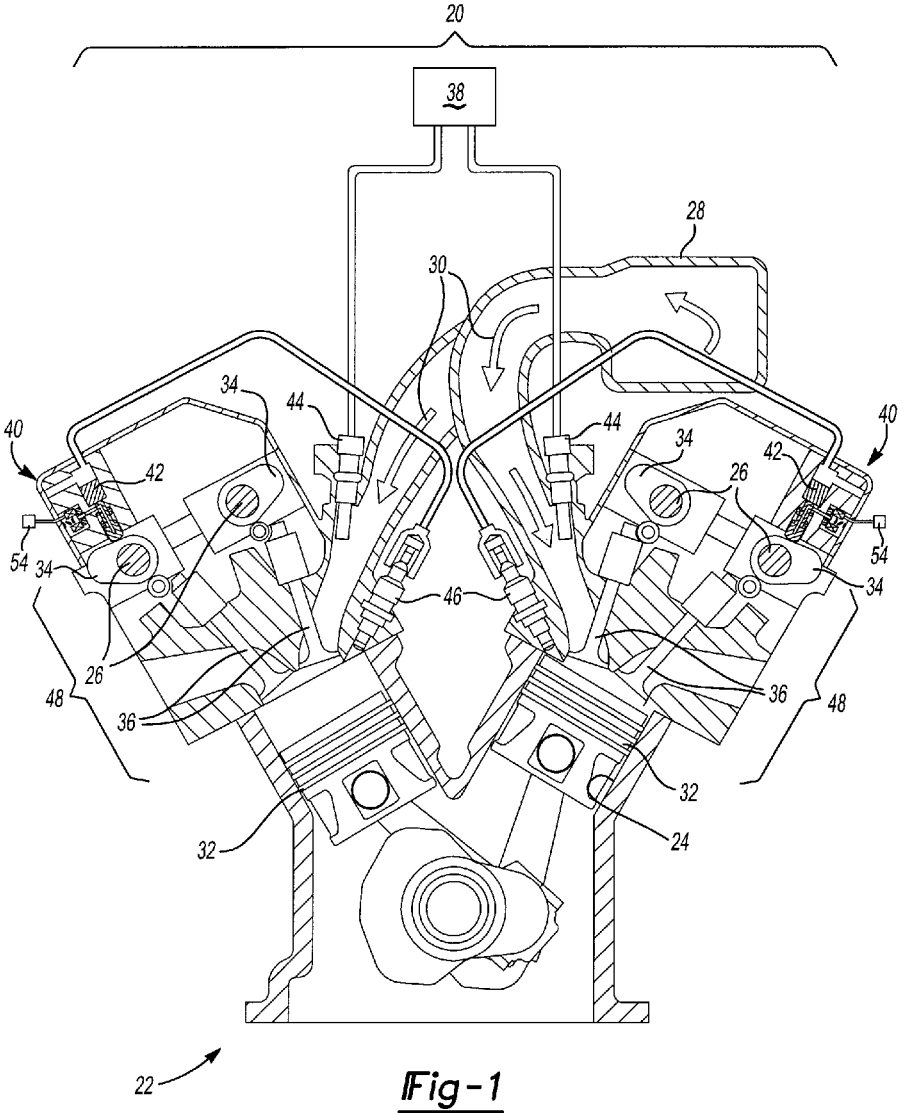
FIG. 1 is a front cut-away view illustrating an engine having an exemplary fuel injection system constructed in accordance with the subject disclosure.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, a fuel injection system 20 for an engine 22 is disclosed. The engine 22 may have at least one cylinder 24, a camshaft 26, and an intake plenum 28 arranged along an intake path 30. The engine 22 may be one of a variety of different types of internal combustion engines. For example and without limitation, the engine 22 may be a gasoline engine that has combined port fuel injection and direct fuel injection. The at least one cylinder 24 of the engine 22 receives a piston 32 and generally defines an area in which combustion of an air/fuel mixture occurs. The intake path 30 generally extends to the at least one cylinder 24 and provides an intake charge including at least air to the cylinder 24 for combustion. The camshaft 26 is rotatably driven by the engine 22. The camshaft 26 may include one or more lobes 34 that may have an elliptical shape. In one form, the lobes 34 of the camshaft 26 generally open and close valves 36 that control the flow of the intake charge into the at least one cylinder 24 and the flow of exhaust exiting the at least one cylinder 24.

Figure 2:
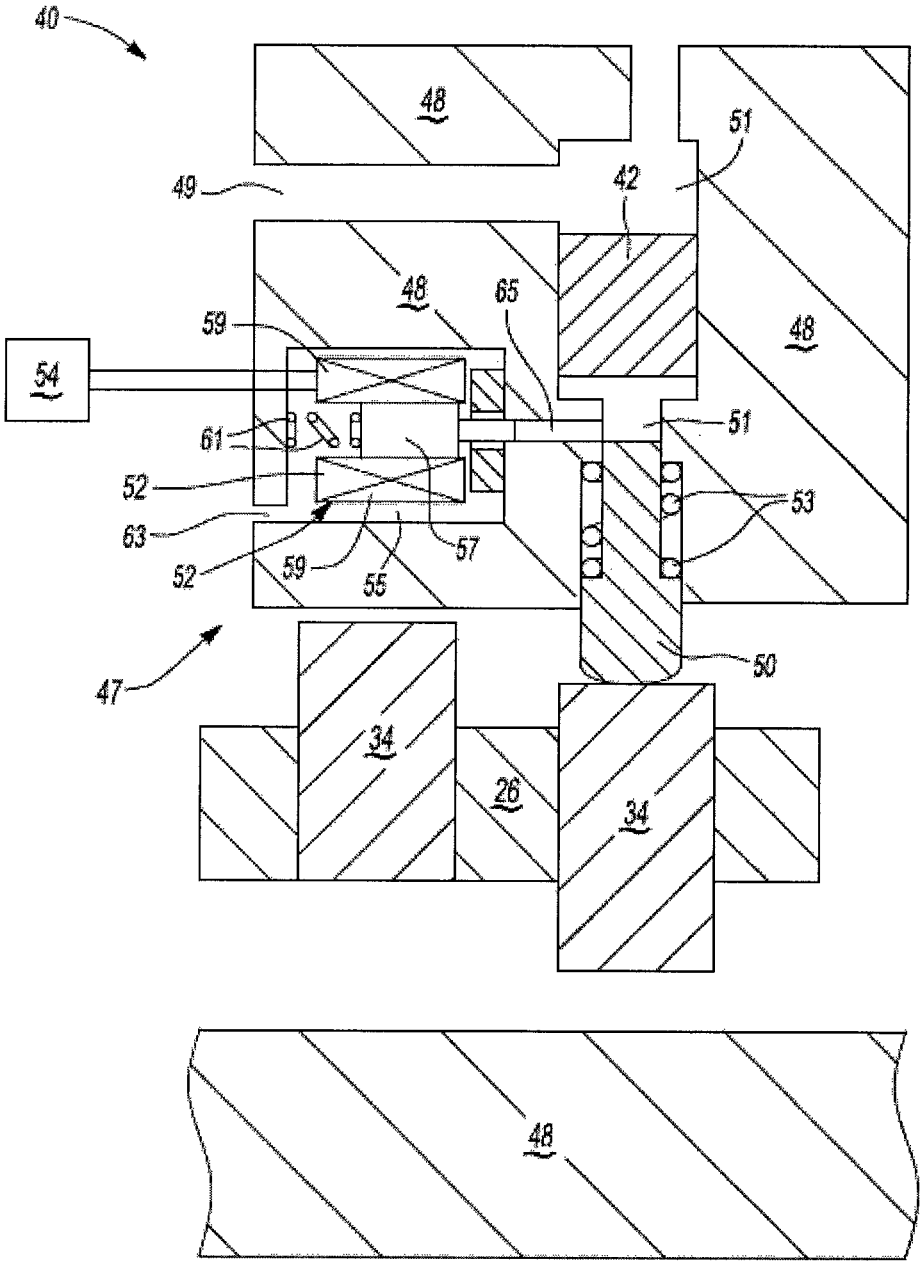
FIG. 2 is an exploded section view of a lost motion lifter of the exemplary fuel injection system of the subject disclosure.
Figure 3:
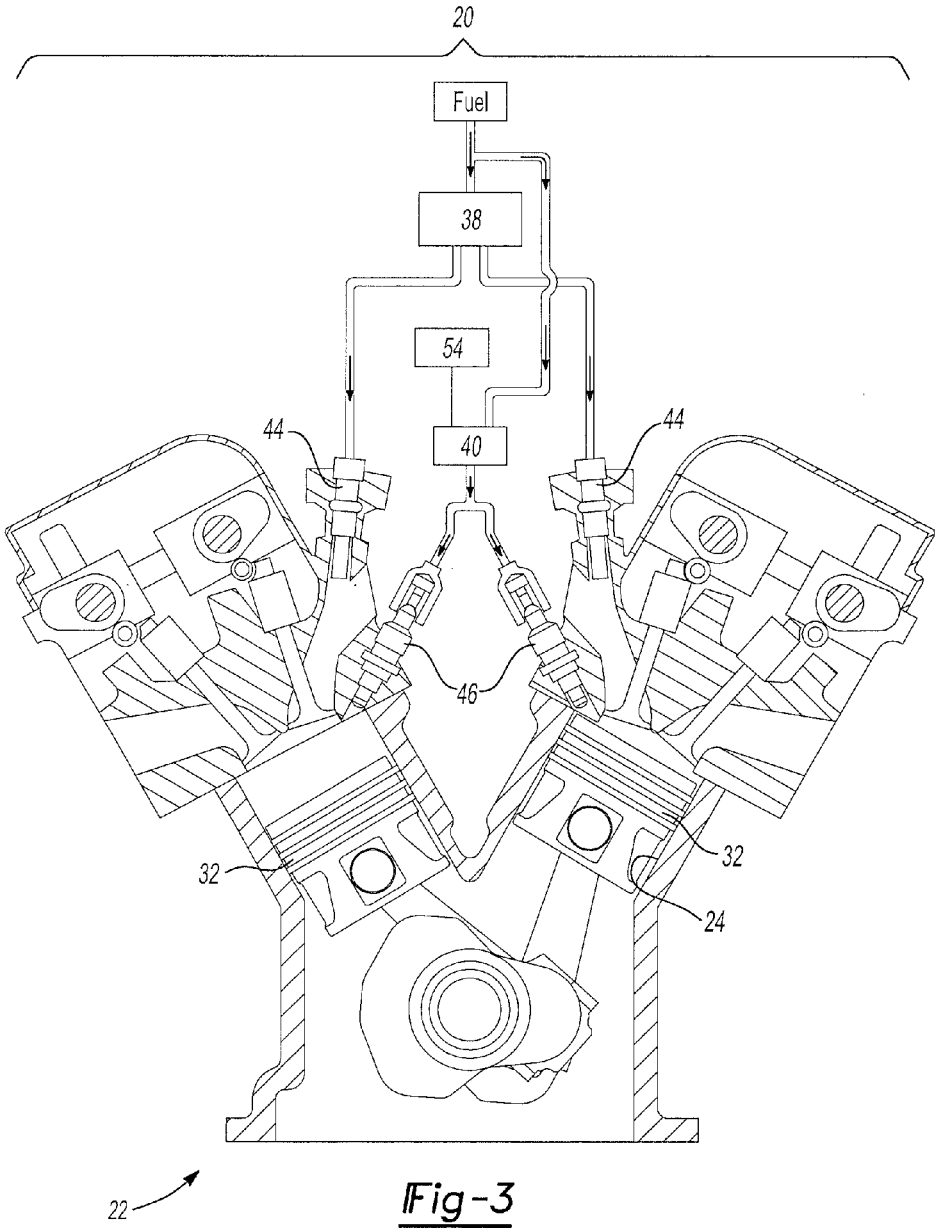
FIG. 3 is a schematic diagram illustrating the exemplary fuel injection system of the subject disclosure.

Referring now to FIGS. 1-3, the fuel injection system includes a low-pressure fuel pump 38 for supplying fuel at a first pressure P1 and a high-pressure fuel pump 40 for supplying fuel at a second pressure P2. The second pressure P2 is greater than the first pressure P1. Accordingly, the fuel pressure supplied by the high-pressure fuel pump 40 is higher than the fuel pressure supplied by the low-pressure fuel pump 38. It should be appreciated that such low-pressure fuel pumps 38 are known in the automotive industry for use in port fuel injection systems while such high-pressure fuel pumps 40 are known in the automotive industry for use in direct fuel injection systems. It should also be appreciated that the low-pressure fuel pump 38 and the high-pressure fuel pump 40 may take a variety of different forms. For example and without limitation, one or both of the low-pressure fuel pump 38 and the high-pressure fuel pump 40 may be a mechanical fuel pump or an electric fuel pump. The high-pressure fuel pump 40 may further include at least one plunger 42. The at least one plunger 42 may generally reciprocate within the high-pressure fuel pump 40.

The fuel injection system 20 also includes at least one port fuel injector 44 and at least one direct fuel injector 46. The at least one port fuel injector 44 is connected in fluid communication with the low-pressure fuel pump 38 and is disposed along the intake path 30. More particularly, the at least one port fuel injector 44 may be disposed along the intake plenum 28 of the engine 22.

The at least one port fuel injector 44 has an activated state and a deactivated state. When in the activated state, the at least one port fuel injector 44 injects fuel into the intake path 30 of the engine 22. It should be appreciated that in the activated state, the at least one port fuel injector 44 may not continuously inject fuel into the intake path 30 but is more generally in an operating state where the at least one port fuel injector 44 injects fuel into the intake path 30 at specified intervals. By contrast, when the at least one port fuel injector 44 is in the deactivated state, port fuel injection is disabled. In other words, the at least one port fuel injector 44 remains closed and does not inject fuel into the intake path 30 of the engine 22 when the port fuel injector 44 is in the deactivated state.

The at least one direct fuel injector 46 is connected in fluid communication with the high-pressure fuel pump 40 and disposed adjacent to the at least one cylinder 24 of the engine 22. More particularly, the at least one direct fuel injector 46 may be installed in a cylinder head 48 of the engine 22 adjacent to the at least one cylinder 24. The at least one direct fuel injector 46 has an activated state and a deactivated state. When in the activated state, the at least one direct fuel injector 46 injects fuel directly into the at least one cylinder 24 of the engine 22. It should be appreciated that in the activated state, the at least one direct fuel injector 46 may not continuously inject fuel into the at least one cylinder 24, but is more generally in an operating state where the at least one direct fuel injector 46 injects fuel into the at least one cylinder 24 at specified intervals. By contrast, when the at least one direct fuel injector 46 is in the deactivated state, direct fuel injection is disabled. In other words, the at least one direct fuel injector 46 remains closed and does not inject fuel into the at least one cylinder 24 of the engine 22 when the direct fuel injector 46 is in the deactivated state.

Port fuel injection is sometimes referred to in the industry under different names including, for example, electronic fuel injection, multiport fuel injection, and multipoint fuel injection, which may be abbreviated as "PFI," "EFI," and "MPI," respectively. As the term is used herein, port fuel injection is meant to cover all such forms of fuel injection where fuel is introduced into the intake path 30 of the engine 22 by fuel injectors. Direct fuel injection is sometimes referred to in the industry under different names, including for example, direct injection and gasoline direct injection, which may be abbreviated as "DFI," "DI," and "GDI," respectively. As the term is used herein, direct fuel injection is meant to cover all such forms of fuel injection where fuel is introduced directly into one or more cylinders 24 of the engine 22 by fuel injectors.

Referring to FIG. 2, the fuel injection system 20 further includes a lost motion lifter 47. The lost motion lifter 47 includes a cam follower 50 that is selectively coupled with the at least one plunger 42 of the high-pressure fuel pump 40. The cam follower 50 contacts and is driven by the camshaft 26 of the engine 22 and is selectively decoupled from the at least one plunger 42 of the high-pressure fuel pump 40 in response to partial load operation of the engine 22. The lost motion lifter 47 also includes an actuator 52 that switches the lost motion lifter 47 between a coupled state and a decoupled state. The actuator 52 may take many forms, but may be, for example, a hydraulic actuator 52 that is driven by oil pressure from the cylinder head 48.

In the coupled state, movement of the cam follower 50 by the camshaft 26 of the engine 22 drives the at least one plunger 42 of the high-pressure fuel pump 40. In the decoupled state, the cam follower 50 is decoupled from the at least one plunger 42 thereby deactivating the high-pressure fuel pump 40. In the example illustrated in FIG. 2, the cyliner head 48 defines a fuel passageway 49 that is disposed in fluid communication with a pump bore 51. The at least one plunger 42 of the high-pressure fuel pump 40 reciprocates within the pump bore 51 to pump fuel through the fuel passageway 49 when the cam follower 50 is coupled with the at least one plunger 42. A lost motion spring 53 is also disposed in the pump bore 51, which biases the cam follower 50 against the lobe 34 of the camshaft 26. The cylinder head 48 includes an actuator cavity 55 that receives the actuator 52. The actuator 52 includes an armature 57 that is moveable within the actuator cavity 55 and a coil 59 disposed about the armature 57. The actuator cavity 55 includes an inlet 63 that supplies a fluid, such as oil from the cylinder head 48, to the actuator cavity 55 and an outlet 65 that is disposed in fluid communication with the pump bore 51. Movement of the armature 57 selectively opens and closes the outlet 65. When the coil 59 of the actuator 52 is energized, a magnetic field is produced that moves the armature 57 within the actuator cavity 55 to an active position in which the armature 57 closes the outlet 65. A biasing spring 61 may optionally be provided to bias the armature 57 to an inactive position in which the armature 57 opens the outlet 65.

In the coupled state, the armature 57 closes the outlet 65 of the actuator cavity 55. This prevents the flow of fluid from the pump bore 51 to the actuator cavity 55 as the lobe 34 of the camshaft 26 drives the cam follower 50 further into the pump bore 51. Because the outlet 65 is sealed, the fluid in the pump bore 51 between the cam follower 50 and the at least one plunger 42 forces the at least one plunger 42 to move with the cam follower 50 thereby coupling the cam follower 50 with the at least one plunger 42. In other words, a hydraulic coupling relates motion of the cam follower 50 and the at least one piston 42 in the coupled state. In the decoupled state, the armature 57 opens the outlet 65 of the actuator cavity 55 creating a by-pass where fluid can enter and exit the pump bore 51 thus decoupling the at least one plunger 42 from the cam follower 50. Because the outlet 65 is open, the fluid in the pump bore 51 between the cam follower 50 and the at least one plunger 42 can flow into the actuator cavity 55 as the lobe 34 of the camshaft 26 drives the cam follower 50 further into the pump bore 51. Accordingly, the volume of fluid between the cam follower 50 and the at least one plunger 42 is free to change such that the at least one plunger 42 may remain in place. In other words, the cam follower 50 of the lost motion lifter 47 can move independtly of the at least one plunger 42 in the decoupled state.

The fuel injection system 20 also includes a pump deactivation module 54. The pump deactivation module 54 is connected to the actuator 52 of the lost motion lifter 47, the at least one port fuel injector 44, and the at least one direct fuel injector 46. Various forms of connection can be used including, but not limited to, wired electrical connection, wireless electrical connection, mechanical connection, hydraulic connection, and pneumatic connection. As such, the pump deactivation module 54 may simultaneously control the actuator 52 of the lost motion lifter 47 and activation of the at least one port fuel injector 44 and the at least one direct fuel injector 46.

The pump deactivation module 54 receives at least one operating parameter of the engine 22 that correlates with engine load and may be, for example, throttle position and/or rotational speed of the engine 22. Accordingly, the pump deactivation module 54 detects partial load operation and full load operation of the engine 22 based on the at least one operating parameter of the engine 22. In one example, the pump deactivation module 54 has a memory that stores at least one look-up table correlating the at least one operating parameter of the engine 22 with partial load operation and full load operation. By accessing the at least one look-up table, the pump deactivation module 54 can detect whether the engine 22 is running at partial load operation or at full load operation.

In response to detecting partial load operation of the engine 22, the pump deactivation module 54 switches the lost motion lifter 47 to the decoupled state, the at least one port fuel injector 44 to the activated state, and the at least one direct fuel injector 46 to the deactivated state. In other words, the pump deactivation module 54 activates port fuel injection and disables direct fuel injection at partial load operation. The pump deactivation module 54 also decouples the high-pressure fuel pump 40 from the engine 22 at partial load operation.

Advantageously, the efficiency of the engine 22 is thus increased at partial load operation for a number of reasons. First, by decoupling the high-pressure fuel pump 40 from the engine 22 at partial load operation, the parasitic losses associated with driving the high-pressure fuel pump 40 at partial load operation are eliminated. Second, direct fuel injection produces increased carbon monoxide (CO) emissions due to poorer mixture quality of the air and fuel mixture when compared to port fuel injection. This increase in carbon monoxide emissions reduces combustion performance and may require increased emissions controls, which result in reduced engine efficiency. By switching to port fuel injection during partial load operation of the engine 22, the disclosed fuel injection system 20 reduces carbon monoxide emissions at partial load operation thereby increasing engine efficiency. Third, direct fuel injection increases the pumping mean effective pressure (PMEP) of the engine 22 at partial load operation of the engine 22 because the charge cooling provided by the fuel increases volumetric efficiency. In turn, this requires increased throttling of the engine 22 at partial load operation, which reduces the efficiency of the engine 22 at partial load operation. By switching to port fuel injection during partial load operation of the engine 22, the disclosed fuel injection system 20 reduces the amount of throttling required at partial load operation and thereby increases engine efficiency at partial load operation.

In response to detecting full load operation of the engine 22, the pump deactivation module 54 switches the lost motion lifter 47 to the coupled position, the at least one port fuel injector 44 to the deactivated state, and the at least one direct fuel injector 46 to the activated state. In other words, the pump deactivation module 54 activates direct fuel injection and disables port fuel injection at full load operation. By activating direct injection, the pump deactivation module 54 activates the high-pressure fuel pump 40 by coupling the high-pressure fuel pump 40 with the engine 22. Advantageously, activation of direct fuel injection at full load operation increases the efficiency of the engine 22 at full load operation because the charge cooling effect of fuel being directly injected into the at least one cylinder 24 of the engine 22 allows for high compression ratios to be used. More specifically, the fuel that is directly injected into the at least one cylinder 24 reduces the temperature of the intake charge as latent heat is taken from the intake charge to evaporate the fuel. Thus, higher compression ratios within the at least one cylinder 24 of the engine 22 can be used without inducing knock at full load operation. More particularly, the charge cooling effect of direct fuel injection minimizes the risk of knock at full load operation. Higher compression ratios are more efficient at full load operation of the engine 22 so the disclosed system increases efficiency of the engine 22 at full load operation by activating direct injection at full load operation where the engine 22 is knock limited.

In another form, the pump deactivation module may switch the lost motion lifter 47 to the coupled state and the at least one direct fuel injector 46 to the activated state while leaving the at least one port fuel injector 44 in the activated state in response to detecting full load operation of the engine 22. In other words, the pump deactivation module activates direct fuel injection, but may optionally leave port fuel injection activated at full load operation. In this configuration, fuel may be injected by both the at least one direct fuel injector 46 and the at least one port fuel injector 44 simultaneously or in sequence. It should also be understood that the amount of fuel injected by each of the at least one direct fuel injector 46 and the at least one port fuel injector 44 may vary. For example, the at least one port fuel injector 44 may inject a reduced amount of fuel into the intake path 30 of the engine 22 in response to activation of the at least one direct fuel injector 46.

The term "knock" refers to an unwanted operating condition of the engine 22 where one or more pockets of the air and fuel mixture in the at least one cylinder 24 explode outside the envelope of the normal combustion front. Such explosions put stress on the engine 22 and can lead to engine failures. For example, knock can lead to deleterious pre-detonation in the engine 22. In this application, the term "full load operation" describes an operating range of the engine 22 where the engine 22 is knock limited. Typically, full load operation occurs at an upper portion of the engine's operating range where higher rotational speeds of the engine 22 are observed. In other words, full load operation often occurs where the engine 22 operates at high revolutions per minute (RPMs). For example and without limitation, full load operation may include all rotational speeds of the engine 22 that meet or exceed a pre-determined value, such as 4000 RPMs. By contrast, the term "partial load operation" describes an operating range of the engine where the engine 22 is not knock limited. Typically, partial load operation occurs at lower and middle portions of the engine's 22 operating range where lower rotational speeds of the engine 22 are observed. In other words, partial load operation often occurs where the engine 22 operates at lower revolutions per minute (RPMs). For example and without limitation, partial load operation may include all rotational speeds of the engine 22 that are less than the pre-determined value, such as 4,000 RPMs.

In this application, the term "module" in pump deactivation module 54 may be replaced with the term "circuit." The term "module" may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term "code," as used above, may include software, firmware, and/or microcode, and may refer to programs, routines, functions, classes, and/or objects. The term "shared processor" encompasses a single processor that executes some or all code from multiple modules. The term "group processor" encompasses a processor that, in combination with additional processors, executes some or all code from one or more modules. The term "shared memory" encompasses a single memory that stores some or all code from multiple modules. The term "group memory" encompasses a memory that, in combination with additional memories, stores some or all code from one or more modules. The term "memory" may be a subset of the term "computer-readable medium." The term "computer-readable medium" does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The present disclosure also sets forth a method of injecting fuel into an intake path 30 of an engine 22 having at least one cylinder 24, such as through use of the fuel injection system 20 described above. Now referring to FIG. 4, the method includes step 100 of providing a low-pressure fuel pump 38 connected in fluid communication with at least one port fuel injector 44 and a high-pressure fuel pump 40 connected in fluid communication with at least one direct fuel injector 46. The high-pressure fuel pump 40 is selectively coupled to the engine 22 by a lost motion lifter 47. The method also includes step 102 of receiving at least one operating parameter of the engine 22 that correlates with engine load. By way of example and without limitation, the at least one operating parameter may include throttle position and/or rotational speed of the engine 22.

In response to receiving the at least one operating parameter, the method proceeds to step 104 of detecting partial load operation and full load operation of the engine 22 based on the at least one operating parameter of the engine 22. The method further includes step 106 of controlling the lost motion lifter 47 to decouple the high-pressure fuel pump 40 from the engine in response to detecting partial load operation of the engine 22.

The method may additionally include step 108 of activating the at least one port fuel injector 44 in response to detecting partial load operation of the engine 22. It should be understood that step 108 may or may not be performed simultaneously with step 106 of controlling the lost motion lifter 47 to decouple the high-pressure fuel pump 40 from the engine. The method may also include step 110 of deactivating the at least one direct fuel injector 46 in response to detecting partial load operation of the engine 22. It should be understood that step 110 may or may not be performed simultaneously with step 106 of controlling the lost motion lifter 47 to decouple the high-pressure fuel pump 40 from the engine.

The method may further include step 112 of controlling the lost motion lifter 47 to couple the high-pressure fuel pump 40 to the engine 22 in response to detecting full load operation of the engine 22. The method may also include step 114 of activating the at least one direct fuel injector 46 in response to detecting full load operation of the engine 22. It should be understood that step 114 may or may not be performed simultaneously with step 112 of controlling the lost motion lifter 47 to couple the high-pressure fuel pump 40 to the engine. The method may additionally include step 116 of deactivating the at least one port fuel injector 44 in response to detecting full load operation of the engine 22. It should be understood the step 116 may or may not be performed simultaneously with step 112 of controlling the lost motion lifter 47 to couple the high-pressure fuel pump 40 to the engine.

Figure 4:
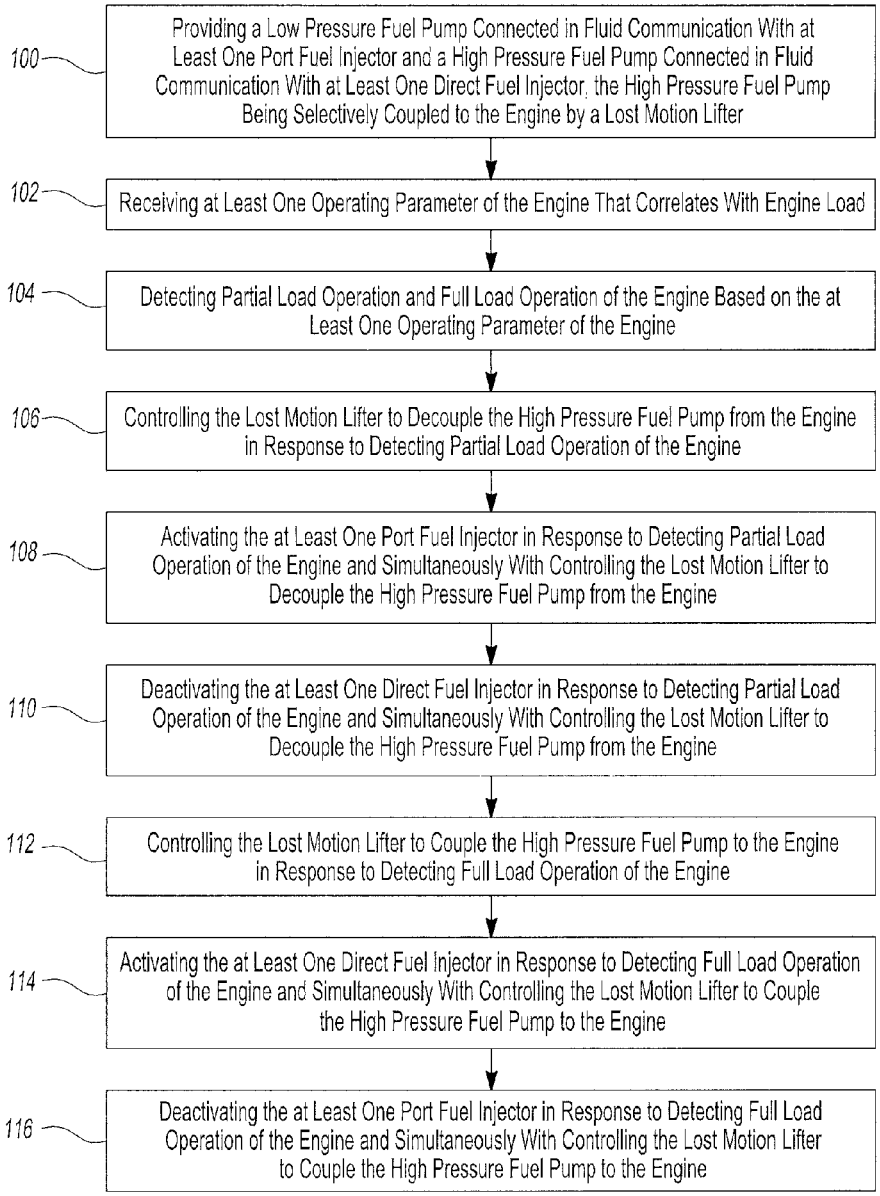
FIG. 4 is a flow diagram illustrating an exemplary method for injecting fuel into an engine in accordance with the subject disclosure.

The method described herein and shown in FIG. 4 is presented for the purpose of illustration and disclosure. As evinced by the appended claims, the method is not limited to all of the steps described herein and labeled as reference numerals 100 through 116 in FIG. 4. Accordingly, the method may be successfully practiced by performing only some of these steps. Additionally, the method is not limited to the order of the steps disclosed herein and illustrated in FIG. 4. The method may be practiced by performing these steps in an alternative order or sequence unless expressly specified otherwise in the claims.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fuel injection system for an engine having an intake path leading to at least one cylinder, comprising:

a low-pressure fuel pump for supplying fuel at a first pressure;

a high-pressure fuel pump for supplying fuel at a second pressure that is greater than said first pressure;

at least one port fuel injector connected in fluid communication with said low-pressure fuel pump and disposed along the intake path of the engine;

at least one direct fuel injector connected in fluid communication with said high-pressure fuel pump and disposed adjacent the at least one cylinder of the engine; and a lost motion lifter selectively coupling said high-pressure fuel pump to the engine in response to full load operation of the engine and decoupling said high-pressure fuel pump in response to partial load operation of the engine, wherein said high-pressure fuel pump supplies fuel to said at least one direct fuel injector when said high-pressure fuel pump is coupled to the engine, wherein said high-pressure fuel pump includes a pump bore, a fuel passageway that is disposed in fluid communication with said pump bore and said at least one direct fuel injector, an outlet that is disposed in fluid communication with said pump bore, and at least one plunger that reciprocates within said pump bore of said high-pressure fuel pump to pump the fuel through said fuel passageway, wherein said lost motion lifter includes a cam follower that contacts and is reciprocally driven by a lobe on a camshaft of the engine and an actuator that opens and closes said outlet to switch said lost motion lifter between a coupled state and a decoupled state, wherein said cam follower is disposed within said pump bore, wherein said outlet is closed by said actuator when said lost motion lifter is in said coupled state such that fluid in said pump bore between said cam follower and said at least one plunger creates a hydraulic coupling that forces said at least one plunger to move with said cam follower, wherein said outlet is open and creates a fluid by-pass when said lost motion lifter is in said decoupled state such that the fluid in said pump bore between said cam follower and said at least one plunger is free to enter and exit said pump bore through said outlet, allowing said cam follower to move independently of said at least one plunger.

2. The fuel injection system of claim 1, further including:

a pump deactivation module connected to said lost motion lifter, said at least one port fuel injector and said at least one direct fuel injector to control said lost motion lifter and activation of said at least one port fuel injector and said at least one direct fuel injector.

3. The fuel injection system of claim 2, wherein said pump deactivation module receives at least one operating parameter of the engine that correlates with engine load and detects partial load operation and full load operation of the engine based on said at least one operating parameter of the engine.

4. The fuel injection system of claim 3, wherein said at least one port fuel injector has an activated state for injecting fuel into the intake path of the engine and a deactivated state for disabling port fuel injection.

5. The fuel injection system of claim 4, wherein said at least one direct fuel injector has an activated state for injecting fuel directly into the at least one cylinder of the engine and a deactivated state for disabling direct fuel injection.

6. The fuel injection system of claim 5 wherein, in response to detecting partial load operation of the engine, said pump deactivation module switches said lost motion lifter to said decoupled state, switches said at least one port fuel injector to said activated state, and switches said at least one direct fuel injector to said deactivated state.

7. The fuel injection system of claim 5 wherein, in response to detecting full load operation of the engine, said pump deactivation module switches said lost motion lifter to said coupled state, switches said at least one port fuel injector to said deactivated state, and switches said at least one direct fuel injector to said activated state.

8. The fuel injection system of claim 5 wherein, in response to detecting full load operation of the engine, said pump deactivation module switches said lost motion lifter to said coupled state, switches said at least one direct fuel injector to said activated state, and leaves said at least one port fuel injector to said activated state.

9. The fuel injection system of claim 2, wherein said pump deactivation module controls said lost motion lifter and activation of said at least one port fuel injector and said at least one direct fuel injector.

10. The fuel injection system of claim 1, wherein said pump bore of said high-pressure fuel pump is disposed within a cylinder head of the engine and wherein said actuator is a hydraulic actuator that is driven by oil pressure from the cylinder head.

11. The fuel injection system of claim 1, wherein the lobe of the camshaft that drives said cam follower is axially aligned with said cam follower and does not move axially on the camshaft.

12. The fuel injection system of claim 1, wherein said actuator includes an armature and a coil disposed about said armature, wherein movement of said armature selectively opens and closes said outlet, and wherein said coil produces a magnetic field when said coil is energized that moves said armature to an active position where said armature closes said outlet.

13. The fuel injection system of claim 1, wherein the fluid in said pump bore between said cam follower and said at least one plunger has a volume that remains free to change when said outlet is open, allowing said at least one plunger to remain in place as said cam follower reciprocates in said pump bore.

14. The fuel injection system of claim 1, wherein the fluid in said pump bore between said cam follower and said at least one plunger is engine oil.

15. The fuel injection system of claim 1, wherein the lobe of the camshaft that drives said cam follower also opens and closes at least one intake valve or exhaust valve of the engine.

16. The fuel injection system of claim 1, wherein the lobe of the camshaft that drives said cam follower is fixed to the camshaft and cannot move axially on the camshaft.

17. The fuel injection system of claim 1, wherein said lost motion lifter is switched to said coupled state when the engine speed is greater than or equal to a pre-determined value and said lost motion lifter is switched to said decoupled state when the engine speed is less than said pre-determined value.

18. A fuel injection system for an engine having an intake path leading to at least one cylinder and a camshaft, comprising:

a high-pressure fuel pump;

said high-pressure fuel pump including at least one plunger that reciprocates within said high-pressure fuel pump;

said high-pressure fuel pump including a pump bore, a fuel passageway that is disposed in fluid communication with said pump bore, an outlet that is disposed in fluid communication with said pump bore, and at least one plunger that reciprocates within said pump bore of said high-pressure fuel pump to pump fuel through said fuel passageway; and a lost motion lifter including a cam follower that contacts and is reciprocally driven by a lobe on the camshaft of the engine and an actuator that opens and closes said outlet to switch said lost motion lifter between a coupled state and a decoupled state, wherein said cam follower is disposed within said pump bore, wherein said high-pressure fuel pump supplies fuel to the engine when said cam follower is coupled to said at least one plunger, wherein said outlet is closed by said actuator when said lost motion lifter is in said coupled state such that fluid in said pump bore between said cam follower and said at least one plunger creates a hydraulic coupling that forces said at least one plunger to move with said cam follower, wherein said outlet is open and creates a fluid by-pass when said lost motion lifter is in said decoupled state such that the fluid in said pump bore between said cam follower and said at least one plunger is free to enter and exit said pump bore through said outlet, allowing said cam follower to move independently of said at least one plunger.

19. The fuel injection system of claim 18, further including:

a pump deactivation module connected to said actuator of said lost motion lifter that receives at least one operating parameter of the engine and determines whether the engine is running at said full load operation or at said partial load operation.

20. The fuel injection system of claim 19, wherein said pump deactivation module controls said actuator to switch said lost motion lifter to said decoupled state in response to determining said partial load operation of the engine and controls said actuator to switch said lost motion lifter to said coupled state in response to detecting said full load operation of the engine.

21. A fuel injection system for an engine having at least one cylinder, a camshaft, and an intake plenum arranged along an intake path, comprising:

a low-pressure fuel pump for supplying fuel at a first pressure;

a high-pressure fuel pump for supplying fuel at a second pressure that is greater than said first pressure;

said high-pressure fuel pump including a pump bore, a fuel passageway that is disposed in fluid communication with said pump bore, an outlet that is disposed in fluid communication with said pump bore, and at least one plunger that reciprocates within said high-pressure fuel pump to pump the fuel through said fuel passageway;

at least one port fuel injector connected in fluid communication with said low-pressure fuel pump and disposed along the intake plenum of the engine;

said at least one port fuel injector having an activated state for injecting fuel into the intake path of the engine and a deactivated state for disabling port fuel injection;

at least one direct fuel injector connected in fluid communication with said fuel passageway of said high-pressure fuel pump and disposed adjacent the at least one cylinder of the engine;

said at least one direct fuel injector having an activated state for injecting fuel directly into the at least one cylinder of the engine and a deactivated state for disabling direct fuel injection;

a lost motion lifter including a cam follower that contacts and is reciprocally driven by a lobe of the camshaft of the engine and that is selectively coupled to said at least one plunger of said high-pressure fuel pump, wherein said cam follower is disposed within said pump bore, wherein said high-pressure fuel pump supplies fuel to said at least one direct fuel injector when said cam follower is coupled to said at least one plunger;

said lost motion lifter including an actuator that opens and closes said outlet to switches said lost motion lifter between a coupled state and a decoupled state, wherein said actuator switches said lost motion lifter to said decoupled state by selectively decoupling said at least one plunger of said high-pressure fuel pump from said camshaft follower in response to partial load operation of the engine and switches said lost motion lifter to said coupled state by selectively coupling said at least one plunger of said high-pressure fuel pump with said camshaft follower in response to full load operation of the engine, wherein said outlet is closed by said actuator when said lost motion lifter is in said coupled state such that fluid in said pump bore between said cam follower and said at least one plunger creates a hydraulic coupling that forces said at least one plunger to move with said cam follower, wherein said outlet is open and creates a fluid by-pass when said lost motion lifter is in said decoupled state such that the fluid in said pump bore between said cam follower and said at least one plunger is free to enter and exit said pump bore through said outlet, allowing said cam follower to move independently of said at least one plunger;

a pump deactivation module connected to said actuator of said lost motion lifter and said at least one port fuel injector and said at least one direct fuel injector to control said actuator of said lost motion lifter and activation of said at least one port fuel injector and said at least one direct fuel injector; and said pump deactivation module receiving at least one operating parameter of the engine that correlates with engine load to detect partial load operation and full load operation of the engine based on said at least one operating parameter of the engine, wherein, in response to detecting partial load operation of the engine, said pump deactivation module switches said at least one port fuel injector to said activated state, switches said at least one direct fuel injector to said deactivated state, and controls said actuator to switch said lost motion lifter to said decoupled state, and wherein, in response to detecting full load operation of the engine, said pump deactivation module switches said at least one port fuel injector to said deactivated state, switches said at least one direct fuel injector to said activated state, and controls said actuator to switch said lost motion lifter to said coupled state.

22. A method of injecting fuel into an engine having at least one cylinder, the method comprising the steps of:

providing a low-pressure fuel pump connected in fluid communication with at least one port fuel injector and a high-pressure fuel pump connected in fluid communication with at least one direct fuel injector, the high-pressure fuel pump including a pump bore, an outlet disposed in fluid communication with the pump bore, and at least one plunger that reciprocates within the pump bore and that is selectively coupled to a cam follower that is disposed in the pump bore and is reciprocally driven by a camshaft of the engine;

receiving at least one operating parameter of the engine that correlates with engine load;

detecting partial load operation and full load operation of the engine based on the at least one operating parameter of the engine; and energizing an actuator to close the outlet to the pump bore in response to detecting full load operation of the engine to hydraulically couple the cam follower and the at least one plunger and force the at least one plunger to reciprocate with the cam follower in the pump bore thereby activating the high-pressure fuel pump and supplying pressurized fuel to the at least one direct fuel injector.

23. The method of claim 22, further comprising:

de-energizing the actuator to open the outlet to the pump bore in response to detecting partial load operation of the engine to permit fluid in the pump bore between the cam follower and the at least one plunger to enter and exit the pump bore through the outlet, allowing the cam follower to reciprocate in the pump bore independently of the at least one plunger and deactivating the high-pressure fuel pump.

24. The method of claim 23, further comprising:

activating the at least one port fuel injector in response to detecting partial load operation of the engine and with decoupling the high-pressure fuel pump.

25. The method of claim 24, further comprising:

deactivating the at least one direct fuel injector in response to detecting partial load operation of the engine and with decoupling the high-pressure fuel pump.

26. The method of claim 25, further comprising:

activating the at least one direct fuel injector in response to detecting full load operation of the engine and with coupling the high-pressure fuel pump.

27. The method of claim 22, further comprising:

deactivating the at least one port fuel injector in response to detecting full load operation of the engine and with coupling the high-pressure fuel pump.

* * * * *